United States Patent [19]

Fox

[11] 4,333,510

[45] Jun. 8, 1982

[54] TILT ROD SUPPORT FOR A VENETIAN BLIND

[75] Inventor: Mark A. Fox, Montoursville, Pa.

[73] Assignee: Marathon Manufacturing Company, Houston, Tex.

[21] Appl. No.: 216,776

[22] Filed: Dec. 29, 1980

[51] Int. Cl.[3] ..... E06B 9/38

[52] U.S. Cl. ..... 160/177

[58] Field of Search ..... 160/177, 173, 178, 176, 160/172

[56] References Cited

U.S. PATENT DOCUMENTS

| | | | |
|---|---|---|---|
| 2,593,048 | 4/1952 | Nelson | 160/177 |
| 2,721,609 | 10/1955 | Rutledge | 160/177 |
| 2,798,546 | 7/1957 | Rice et al. | 160/177 X |
| 2,809,531 | 10/1957 | Moyer | 160/177 X |
| 3,333,905 | 8/1967 | Hennequin | 160/177 X |
| 3,447,585 | 6/1969 | Lorentzen et al. | 160/178 R |
| 3,630,264 | 12/1971 | Debs et al. | 160/177 |
| 4,224,974 | 9/1980 | Anderson et al. | 160/178 R |

*Primary Examiner*—Philip C. Kannan

*Attorney, Agent, or Firm*—Robert K. Youtie

[57] ABSTRACT

A support for mounting a tilt rod in the head rail of a venetian blind, including a bottom wall or base for resting on the bottom wall of a head rail with depending retainer means for snap retaining engagement through the bottom of the head rail, a pair of spaced side or end walls upstanding from the base and having aligned cut-outs extending downwardly for rotatably receiving a tilt rod, and resiliently deflectable projections extending into at least one cut-out for snap passage therebetween and releasable retention thereby of a tilt rod in the associated cut out.

11 Claims, 4 Drawing Figures

TILT ROD SUPPORT FOR A VENETIAN BLIND

BACKGROUND OF THE INVENTION

As is well known to those versed in the venetian blind art, a variety of tilt rod supports have been used in the past, primarily being of stamped sheet metal and composite metal and plastic, requiring special tools for assembly with a head rail, and forming operations subsequent to assembly with a head rail and tilt rod. Also, the metal edges caused unduly rapid wear of venetian blind cords and ladders.

In addition, the per unit cost of prior tilt rod supports was relatively high, especially by reason of waste material, and multi-stage manufacturing procedures required.

Of the prior art of which applicant is aware, the closest appears in the below listed patents:

| U.S. Pat. No. | NAME |
|---|---|
| 2,269,434 | NELSON |
| 2,721,609 | RUTLEDGE |
| 2,798,546 | RICE ET AL |
| 2,809,531 | MOYER |
| 3,333,905 | HENNEQUIN |
| 3,630,264 | DEBS |

SUMMARY OF THE INVENTION

Accordingly, it is among the important objects of the present invention to provide a tilt rod support for venetian blinds which is capable of manufacture as an integral or one piece plastic molding for effecting substantial savings in costs of manufacture and materials, is capable of assembly with venetian blind head rails by substantially instantaneous finger snap-in without the need for tools, to effect substantial efficiencies in the assembly procedure, and which eliminates any need for material forming operations during or after assembly. It is still another object of the present invention to provide a tilt rod support for venetian blinds having the advantageous characteristics mentioned in the preceeding paragraphs, which effectively protects the tilt rod from wear, and further enhances the useful life of control cords and ladders by eliminating wear against metal edges, and further facilitates operation by natural lubrication of the tilt rod support material engaging moving parts.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENT

Figure 1:
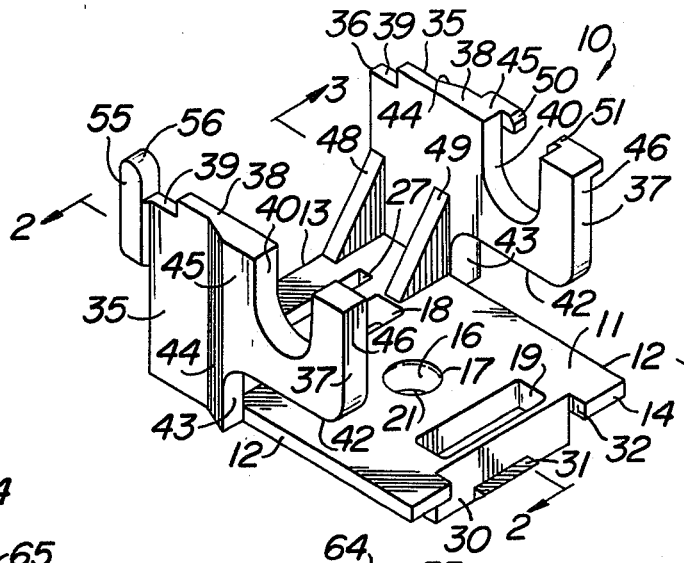
FIG. 1 is a top perspective view showing a tilt rod support of the present invention apart from a venetian blind.

Referring now more particularly to the drawings, and specifically to FIG. 1 thereof, a tilt rod support is there generally designated 10 and may consist of an integral or one-piece plastic unit, fabricated by injection molding or otherwise, as desired.

The support 10 includes a generally rectangular, substantially flat lower wall or base 11 having a pair of laterally spaced, generally parallel side edges 12, and front and rear edges 13 and 14 extending, respectively, between the front and rear ends of the side edges 12. A central cord opening or hole 16 is formed in the base or plate 11 of the support 10. The through hole 16 may have smoothly curved or radiused corners or edges 17. On opposite sides of the cord hole 16, forwardly and rearwardly thereof, are located laterally elongate, front and rear ladder openings or slots 18 and 19, respectively in adjacent, spaced parallelism with the front and rear base edges 13 and 14.

Depending from the under surface of the generally flat base 11, peripherally bounding the circular cord opening or hole 16 is a circular ridge, rim or rib 21. Also depending from the under side of base 11 is a peripheral rim, rib or ridge 22, bounding the forward ladder opening 18. Similarly, depending from a rearward region of the bottom plate or base 11, extending peripherally about the rear ladder opening 19 is a rib or rim 23.

Figure 2:
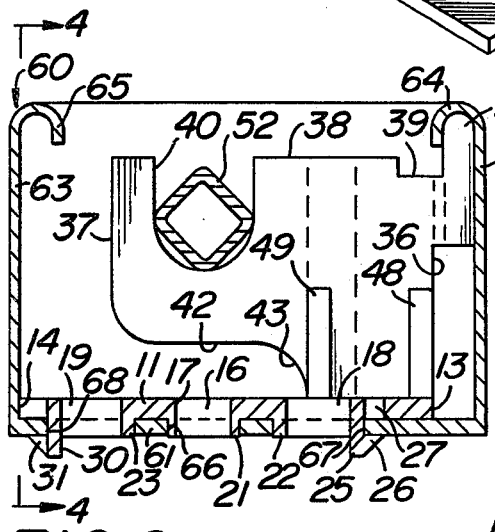
FIG. 2 is a transverse sectional elevational view taken generally along the line 2—2 of FIG. 1, showing the tilt rod support in operative association with a venetian blind head rail.

The forward region of forward depending peripheral rim 22 is provided with a depending extension or wall 25 and provided on its forward side with a downwardly tapering snap catch or retainer 26. The depending wall 25 may be coextensive with the lateral dimension of the depending rim or rib 22, and the snap finger or catch 26 may be laterally coextensive with the depending wall 25. Also, a laterally extending through opening or slot 27 is formed in the bottom wall or base 11 coextensive with the depending retainer wall 25, substantially over the snap retainer 26. This structure is best seen in FIG. 2.

Figure 3:
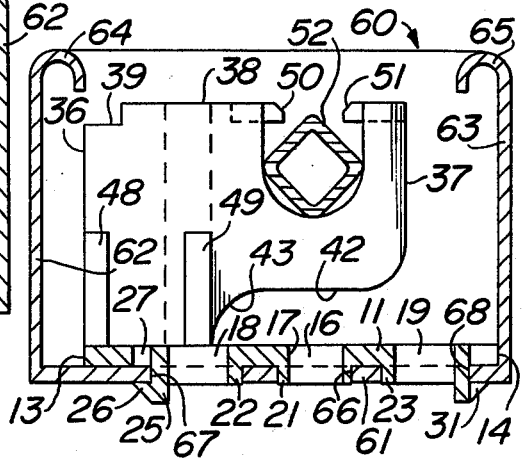
FIG. 3 is a sectional elevational view taken generally along the line 3—3 of FIG. 1, but showing the assembly of FIG. 2.

The rearward region of the depending peripheral rim 23 of rear ladder opening 19 is provided with a laterally extending depending extension or wall 30. The lower edge of the depending extension 30, laterally medially thereof, may carry a downwardly tapering, rearwardly projecting snap retainer or finger 31; and, the rearward, laterally medial region of rear edge 14 of base 11 is notched or cut away laterally coextensive with the depending rear wall 30, as by a notch or cut-out 32. As best seen in FIGS. 2 and 3, the retaining catches or fingers 26 and 31 have generally horizontal upper surfaces spaced below the under side of the base or plate 11.

The depending peripheral rims 21, 22 and 23, and the depending extensions or walls 25 and 30, together with horizontally projecting catches 26 and 31, define bosses on the under or nether side of the base plate 11, for conforming engagement with the bottom wall of a venetian blind head rail, as will appear more fully hereinafter.

Upstanding from opposite side edges 12, 12 of base or plate member 11, adjacent to the forward edge 13, are a pair of generally parallel, spaced side or end walls 35. The walls 35 may each upstand from a respective base side edge 12, having a front edge 36 substantially flush with the front base edge 13, and extending rearwardly to a rear edge 37, short of the rear base edge 14. Each side or end wall 35 upstands to a generally horizontal upper edge 38, which may have its forward end notched or cut away, as at 39.

At a location adjacent to and spaced forwardly from its rear edge 37, each wall 35 is formed with a downwardly extending, generally U-shaped notch or cut-out 40. That is, each cut-out or notch 40 extends downwardly through the upper edge 38 of a respective side wall 35 and terminates short of the base plate 11. The notches 40 of the spaced side walls 35 are in alignment with each other laterally of the base plate 11, and in substantial alignment with the central cord opening 16.

Extending forwardly from the rear edge 37 of each side wall 35 is a cut-out or opening 42, which extends in spaced relation beneath the notch or cut-out 40. That is, each opening 42 extends forwardly from the rear wall edge 37, being spaced below the associated cut-out 40 and opening to the bottom wall or base plate 11, the openings 42 terminating at their forward ends in end edges 43 located forwardly of the cut-outs or notches 40.

The side walls 37, in their rearward regions, have upper cut-outs 40 and lower cut-outs 42. In order that these cut-outs do not weaken the rearward wall regions, their is provided reinforcing or thickening of the rear wall regions, as at 44. It will now be appreciated that the downward cut-outs 40 open upwardly to define of the thickened material on opposite sides thereof a pair of forwardly and rearwardly spaced legs, as at 45 and 46.

Further reinforcing the walls 35 are a pair of forwardly and rearwardly spaced gussets or brackets 48 and 49, both extending between the bottom wall or plate 11 and a respective side wall 35, forwardly of its cut-out 42.

One of the side walls 35 may have its upstanding legs 45 and 46 provided on their upper ends with inwardly extending projections 50 and 51. The forward projection 50 may extend rearwardly into cut-out 40, and the rearward projection 51 may extend forwardly into the cut-out, both projections may be offset laterally outwardly beyond the plane of the wall 35. The proportions of the interned projections 50 and 51, and the legs 45 and 46 carrying the projections, are such as to afford a resilient deflectability between the projections for snap engagement thereby of a venetian blind tilt rod such as the rod 52, as best seen in FIG. 3.

One of the side walls 35 may be formed with an upstanding projection, protuberance or stud, as at 55, on the forward edge 36 of the side wall. That is, the locating projection 55 may extend forwardly from the front edge 36 of the associated side wall 35, and upstand therefrom to a level beyond that of the side wall upper edge 38. Specifically, the locating projection 55 may have its upper end rounded, as at 56, for conforming engagement beneath the upper edge curl of a head rail, as will appear presently.

A conventional head rail is generally designated 60, being of channel-like formation including a bottom wall or web 61, and a pair of upstanding, front and rear side walls or flanges 62 and 63. The upper edge portions of the head rail side walls 62 and 63 may be curled inwardly, as at 64 and 65, respectively. Further, the head rail bottom wall 61 is formed at appropriate locations with a generally circular cord opening or hole 66, and front and rear, elongate ladder openings or holes 67 and 68.

Figure 4:
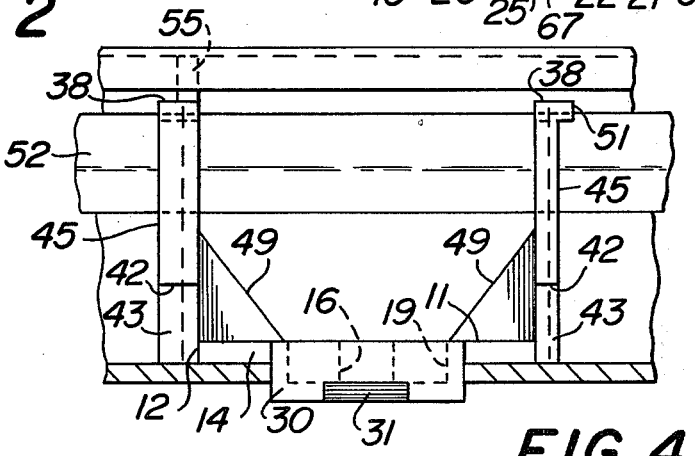
FIG. 4 is a partial sectional view taken generally along the line 4—4 of FIG. 2.

In the assembled condition of FIGS. 2–4, a support 10 has been positioned within a head rail 60, and preferably canted to engage the locating projection 55 upward beneath a head rail edge curl 64. Then by simple manipulation, as thumb pressure or the like, the depending boss means 21, 22 and 23 are engaged downwardly through head rail openings 66, 67 and 68. More particularly, the retaining formations 25, 26 and 30, 31 are snap engaged downwardly through front and rear head rail openings 67 and 68 to the position shown in FIGS. 2 and 3. It will there be apparent that the retaining fingers 26 and 31 are engaged beneath the under side of the head rail bottom wall 61 to effectively retain the support 10 in position within the head rail. Also, the peripheral depending rims or ridges 21, 22 and 23 line their respective, receiving head rail openings 66, 67 and 68, to provide smooth, low friction receivers for the control cords and ladders. Similarly, the cord passing openings or passageways 42 are of smooth plastic material, to further minimize cord wear. Advantageously, the plastic material of the support 10 may be an acetal, such as "SELCON", which may include natural or added lubricating qualities to further minimize wear of the cords and tapes.

From the foregoing, it is seen that the present invention provides a venetian blind tilt rod support which is extremely simple in construction, durable and reliable throughout a long useful life, effects substantial savings in manufacture and assembling operations, effectively protects and minimizes wear upon cord and ladder parts, and otherwise fully accomplishes its intended objects.

Although the present invention has been described in some detail by way of illustration and example for purposes of clarity of understanding, it is understood that certain changes and modifications may be made within the spirit of the invention.

What is claimed is:

1. In a venetian blind, a tilt rod support for mounting a tilt rod in a head rail: said tilt rod support being integrally formed of plastic material and comprising a base for resting in a head rail, nether boss means on said base for conformably engaging through the bottom of said head rail, retainer means on said boss means for retaining engagement with the bottom of said head rail, a pair of spaced walls upstanding from said base and terminating at upper edges, said walls each having a cut-out extending downwardly through its upper edge and defining of the adjacent wall portion a pair of upstanding legs, said cut-outs being in general alignment with each other and adapted to rotatably receive a tilt rod, and projections on at least one pair of said legs extending into the upper region of the associated cut-out, said projections and said one pair of legs being resiliently deflectable to snap pass and releasably retain a tilt rod in said associated cut-out.

2. A venetian blind according to claim 1, said retaining means comprising retaining fingers for snap engagement through and releasable retaining engagement with the head rail bottom.

3. A venetian blind according to claim 2, said retaining fingers being located on opposite sides of said boss means.

4. A venetian blind according to claim 1, in combination with a locating projection upstanding from one of said walls spaced from the associated cut-out for locating engagement with one side of the head rail.

5. A venetian blind according to claim 1, said boss means and base being formed with a through lift cord opening generally in alignment with said cut-outs and a pair of ladder openings on opposite sides of said lift cord opening.

6. A venetian blind according to claim 5, said walls having through opening beneath said cut-outs defining lift cord passage-ways.

7. A venetian blind according to claim 6, said passageways each being formed by an undercut extending inwardly from one side edge of the associated wall beneath the associated cut-out and terminating short of the other side edge of the associated wall.

8. A venetian blind according to claim 6, in combination with a locating projection upstanding from one of said walls approximate to said other side edge of the respective wall, for locating engagement with one side of the head rail.

9. A venetian blind according to claim 6, said walls being reinforced in the region of said cut-outs for effectively supporting said tilt rod.

10. A venetian blind according to claim 9, in combination with depending ridges on the under side of said base in bounding relation with said lift cord and ladder openings, for effectively locating said support and protectively receiving said lift cord and ladder.

11. A venetian blind according to claim 6, said plastic material being acetal, affording natural lubrication to cords, ladders and tilt rod.

* * * * *